United States Patent [19]

Nakamura et al.

[11] Patent Number: 4,594,992

[45] Date of Patent: Jun. 17, 1986

[54] SUPERCHARGER OF AN INTERNAL COMBUSTION ENGINE HAVING ROOTS PUMP

[75] Inventors: Norihiko Nakamura, Mishima; Hidemi Ohnaka, Susono, both of Japan

[73] Assignee: Toyota Jidosha Kabushiki Kaisha, Aichi, Japan

[21] Appl. No.: 748,937

[22] Filed: Jun. 26, 1985

[30] Foreign Application Priority Data

Jul. 2, 1984 [JP] Japan ..... 59-135217

[51] Int. Cl.[4] ..... F02B 33/00

[52] U.S. Cl. ..... 123/559; 418/180

[58] Field of Search ..... 123/559; 418/180

[56] References Cited

U.S. PATENT DOCUMENTS 2,194,196 3/1940 Heinrich ..... 123/564
3,003,426 10/1961 Lauck ..... 418/180

FOREIGN PATENT DOCUMENTS 495119 6/1929 Fed. Rep. of Germany ..... 418/180
59-54785 4/1984 Japan .
469392 7/1937 United Kingdom ..... 123/564

*Primary Examiner*—Douglas Hart
*Attorney, Agent, or Firm*—Parkhurst & Oliff

[57] ABSTRACT

A supercharger of an internal combustion engine having a Roots-type pump comprising; a pair of rotors rotatably mounted in a pump housing so as to rotate synchronously in opposite directions to suck air from an air inlet and discharge it through an air outlet. The pump housing defines annular spaces around the rotor shafts and between the axial end faces of the rotors and bearings rotatably supporting the rotor shafts. The annular spaces are connected to the atmosphere via a control valve, so that the atmospheric air is introduced into the annular spaces during certain engine driving conditions to reduce the pressure difference existing around the bearings.

5 Claims, 3 Drawing Figures

SUPERCHARGER OF AN INTERNAL COMBUSTION ENGINE HAVING ROOTS PUMP

BACKGROUND OF THE INVENTION

1. Field of the Invention

This invention relates to a supercharger of an internal combustion engine having a Roots compressor or pump. More particularly, it relates to a lubrication system for bearings supporting the rotor shafts of a Roots-type pump.

2. Description of the Related Art

A Roots-type pump of a supercharger for an internal combustion engine comprises two hour-glass-shaped rotors mounted on respective rotor shafts. A pumping operation is effected in the pump housing by rotating these rotors synchronously in opposite directions. A small clearance is maintained between the respective rotors and between the rotors and the inner wall of the housing, to compensate for thermal expansion of the rotors or to cope with foreign matter carried into the housing by intake air. These clearances allow the compressed discharge air to leak from the high pressure area to the low pressure area in the supercharger, with the result that the pressure of air discharged from the high pressure area will impinge on the bearings supporting the respective ends of the rotor shafts, and thus a pressure difference is created at opposite sides of the bearings. Each of the bearings is packed with grease for lubrication, as is well known in the art. However, the sealing or holding property or lubricating capacity of the grease may be reduced by this pressure difference.

To prevent a reduction of the holding capacity of the grease caused by the pressure difference mentioned above, a device has been proposed to provide an air passage for communicating the clearance space in the housing with the suction side of the pump, as disclosed in Japanese Unexamined Utility Model Publication (Kokai) No. 59-54785.

Another solution was proposed in which labyrinth is provided between the rotor and the bearings in such a manner that the clearances between the bearings and the labyrinth are connected to the atmosphere to reduce the suction pressure normally acting on the bearings.

In a Roots-type pump of the supercharger of the internal combustion engine, the above-mentioned clearances of the labyrinth between the bearings and the shafts must be necessarily large enough to avoid contact therebetween, and the communicating port to the atmosphere must also be large enough to obtain a reduction of the suction air pressure. In this case, however, in a particular engine driving condition, such as idling in which the flow of suction air is small, the atmospheric pressure may be drawn into the engine through the above-mentioned labyrinth and thus the flow of the suction air will be substantially increased. Accordingly, it will be difficult to reduce the engine speed, even if the throttle valve is almost fully closed to reduce the amount of suction air drawn into the engine.

SUMMARY OF THE INVENTION

An object of the present invention is to provide a supercharger of an internal combustion engine having a Roots compressor or pump, capable of overcoming the disadvantages of the related art.

Another object of the present invention is to provide a supercharger of an internal combustion engine, capable of reducing the pressure acting on the bearings to prevent an increase in engine speed under a particular engine driving condition, such as engine idling, in which the flow of suction air is very small.

According to the present invention, there is provided a supercharger of an internal combustion engine having a Roots-type pump: a pump housing for defining therein a pump chamber having an inner wall and an air inlet and outlet; a pair of rotor shafts mounted in parallel and each rotatably supported in the housing by means of a pair of bearings, the respective rotor shafts each rigidly carrying a rotor in such a manna that small clearances are defined between the pair of rotors and between the rotors and the inner wall of the housing chamber; means for rotating the pair of rotors synchronously in opposite directions to suck air from the air inlet into the pump chamber and discharge the air from the pump chamber through the air outlet; each of the rotors having, at respective axial ends thereof, end faces substantially perpendicular to the rotor shaft; the housing defining annular spaces around the rotor shafts and between the axial end faces of the rotors and the bearings; and, air passage means for connecting the annular spaces in the housing to the atmosphere, the passage means having a valve for controlling the air passage means in accordance with the engine driving conditions.

In an embodiment of this invention, each of the bearings is a rolling bearing comprising an inner bearing race, rolling elements, and an outer bearing race, and the inner bearing race engages with a step portion of the rotor shaft; the inner diameter of the bearing being smaller than that of the annular space adjacent to the bearing. In addition, the outer bearing race of each bearing engages with a step bore portion of the housing; the outer diameter of the bearing being larger than that of the annular space adjacent to the bearing.

DESCRIPTION OF THE PREFERRED EMBODIMENT

Figure 1:
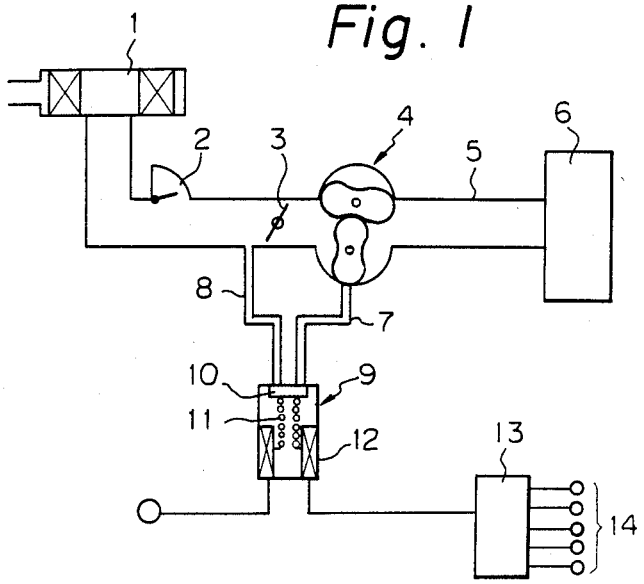
FIG. 1 is a schematic view of a supercharger of an internal combustion engine having a Roots-type pump.

FIG. 1 is a general schematic view of a supercharger of an internal combustion engine having a Roots-type pump according to the present invention, wherein reference numeral 1 designates an air cleaner; 2, an air flow meter; 3, a throttle valve; 4, a supercharger consisting of a Roots-type pump; 5, an air intake passage; 6, an engine body; 9, a control valve; and 13, a computer.

The control valve 9 is provided between an air passage 7, which is connected to annular spaces defined between the labyrinth and bearings in the supercharger 4, as mentioned hereinafter, and an air passage 8, which is connected to the air intake passage adjacent to and downstream of the throttle valve 3. The control valve 9 controls the air communication between the air passages 7 and 8 in accordance with signal instructions from the computer 13. The computer 13 discriminates the engine idling condition on the basis of signals from various sensors 14, such as an speed engine sensor, a vehicle speed sensor, and a throttle opening sensor, and signals from the air flow meter 2, and controls the control valve 9. The control valve 9 may be a solenoid valve well known in the art, and comprises a valve element 10, a spring 11, and a solenoid coil 12.

Figure 3:
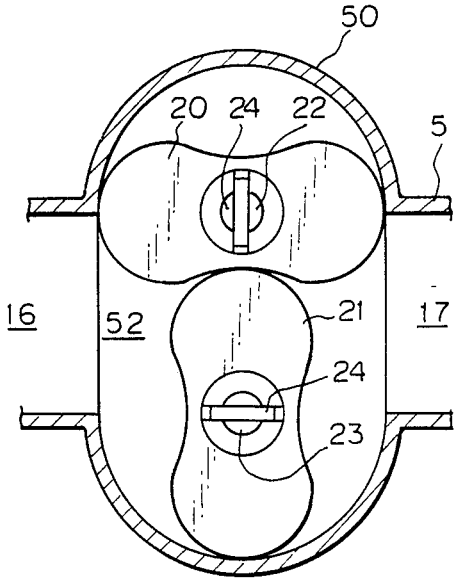
FIG. 3 is a cross-sectional view of the Roots-type pump taken along line III—III in FIG. 2.
Figure 2:
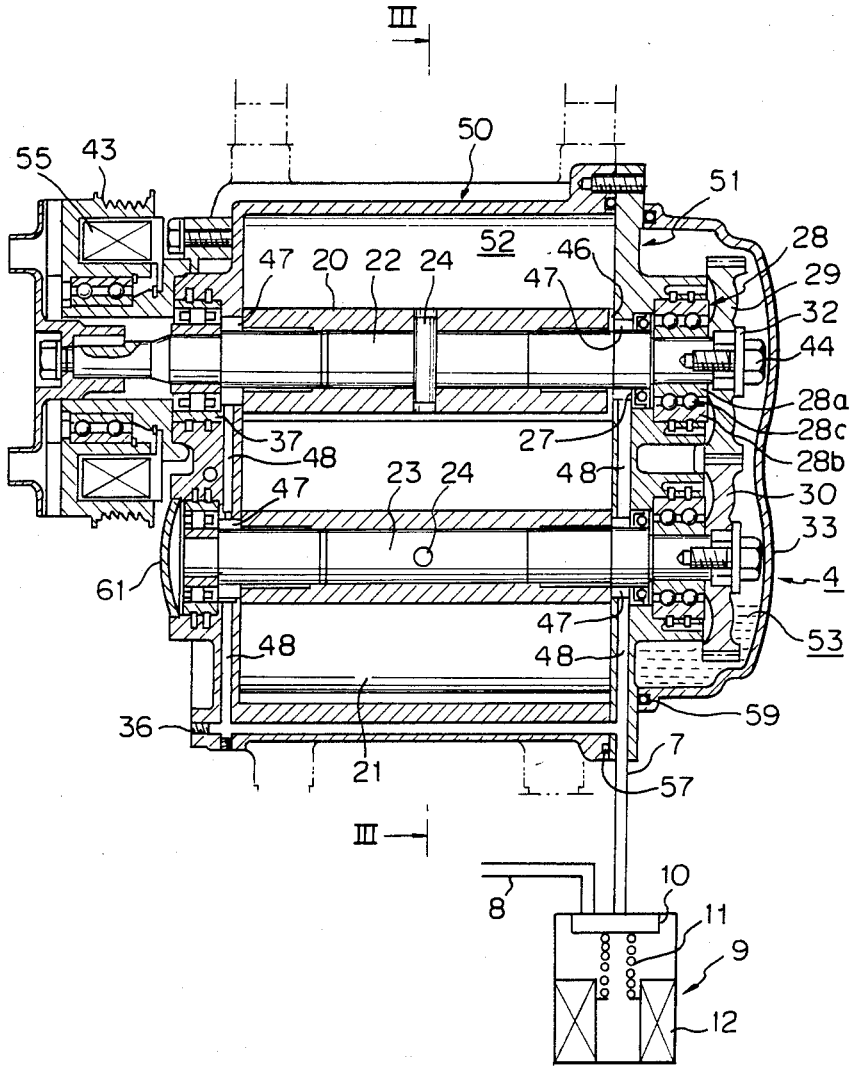
FIG. 2 is a cross-sectional view of the supercharger comprising a Roots pump.

FIGS. 2 and 3 are cross-sectional views of the supercharger comprising a Roots-type pump according to the present invention. In FIG. 2, reference numeral 50 designates a housing body; and 51, a rear plate for closing one of the open ends of the housing body 50. Thus, a pump chamber 52 is constituted by the housing body 50 and the rear plate 51. As known in the prior art, in a Roots-type compressor or pump this pump chamber 52 is provided with a pair of hour-glass-shaped rotors 20 and 21, as illustrated in FIG. 3, supported by rotor shafts 22 and 23, respectively. Reference numeral 24 designates pins fixing the rotors 20 and 21 to the respective rotor shafts 22 and 23. The upper rotor shaft 22 supporting the upper rotor 20 in FIG. 2 is supported at its respective ends by ball bearings 28 and 37 and is rigidly connected to a pulley 43 at one end of the shaft 22 protruded from the bearing 37. The lower rotor 21 is fixed to the lower rotor shaft 23 in the same manner as the above. The lower rotor shaft 23 is supported at its respective ends by bearings 28 and 37, in the same manner as for the upper rotor shaft 22. The respective rotor shafts 22 and 23 are constructed in such a manner that they are rotated through gears 29 and 30. Namely, each of the rotor shafts 22 and 23 is supported by bearings 28 and 37 at their respective ends, as mentioned above, and the rotor shafts 22 and 23 extend backward (to the right in FIG. 2) through the rear bearings 28 and the extended ends thereof are fixed to the gears 29 and 30, respectively, which are mating gears engaged with each other. In the illustrated embodiment, the gears 29 and 30 are fastened to the rotor shafts 22 and 23, respectively, by means of washers 32 and screw bolts 44. A cover 33 is sealingly attached to the rear plate 51 in such a manner that it covers the gears 29 and 30, the rear bearings 28, and the rear end portions of the rotor shafts 22 and 23. An oil chamber 53 thus defined by the cover 33 and the rear plate 51 is filled with a suitable amount of oil for lubricating the gears 29 and 30 and the rear bearings 28.

A pulley 43 is attached to the front end of the upper rotor shaft 22 through a solenoid clutch means 55, as known in the prior art. The pulley 43 is operatively connected to a crankshaft (not shown) of the engine through a belt means (not shown). Thus, when the solenoid clutch means 55 is turned ON, the upper and lower rotors 20 and 21 are simultaneously rotated synchronously in opposite directions so that air is sucked from an air inlet 16 (FIG. 3) and discharged through an air outlet 17 via the pump chamber 52 in such a manner that the air supplied to the engine is pressurized, as well known in the prior art. Reference numeral 57 in FIG. 2 designates an O-ring seal disposed between the housing 50 and the end plate 51 to prevent air leakage into the pump chamber 52; and 59 designates an O-ring seal disposed between the end plate 51 and the cover 33 to prevent oil leakage into the oil chamber 53.

The structure of the bearing means for rotatably supporting the rotor shafts 22 and 23 will now be described in detail, with reference to the particular bearing 28 arranged to support the rear end of the upper rotor shaft 22 as illustrated at the right upper portion of FIG. 2. The bearing 28 is an oil lubrication type ball bearing provided with an oil seal 27 at the side of rotor 21. Thus, the bearing 28 is lubricated by the oil in the oil chamber 53, but the oil is prevented from entering the pump chamber 52 by the oil seal 27. The bearing 28 comprises at least an inner bearing race **28*a*, an outer bearing race 28*b*, and a plurality of ball elements 28*c* disposed therebetween. The bearing 28 is packed with grease for lubrication, as well known in the art. Between the rear end face of the rotor 20 and the end plate 51 there is a small axial gap which defines a so-called labyrinth 46**.

The housing structure 50 including the end plate 51 is provided with an annular space 47 around the rotor shaft 22 and between the above-mentioned labyrinth 46 and oil seal 27. As seen from FIG. 2, the inner bearing race **28*a* of the bearing 28 engages with a step portion of the rotor shaft 22 having a reduced diameter, and the inner diameter of the bearing 28 is smaller than that of the annular space 47. The outer bearing race 28*b* of the bearing 28 engages with a step bore portion of the housing 50 (end plate 51), and the outer diameter of the bearing 28 is larger than that of the annular space 47. The outer side of the inner bearing race 28*a* of the bearing 28 is in contact with the gear 29**.

The annular space 47 is connected to an air port 48 formed in the housing 50 (end plate 51). The air port 48 is connected, through an air passage 7, to an air control valve 9 connected to the atmospheric zone through an air passage 8 positioned upstream of the throttle valve 3 (FIG. 1).

The other three bearings rotatably supporting the rotor shafts 22 and 23 have substantially the same structure as the bearing 28, as mentioned above, except that the oil seals 27 are not provided for the front upper and lower bearings 37. Thus, three other annular spaces 47 are also connected to the control valve 9 through the respective air ports 48 formed in the housing 50 (or end plate 51) and the air passage 7. Reference numeral 36 in FIG. 2 designates a plug screw for sealing the ends of the air ports 48. At the front end of the lower rotor shaft 23, the housing 50 is closed by a seal cover 61.

The bearing oil seal 27 of the rear bearing 28 is subjected to the suction air pressure transmitted from the pump chamber 52 in the housing 50 through the labyrinth portions 46. However, under normal driving conditions, the control valve 9 is turned On and, therefore, the valve element 10 is pulled toward the solenoid coil 12 against the spring 11. This allows the air passages 7 and 8 to be communicated with each other, and thus the atmospheric pressure at the upstream side of the throttle valve 3 (FIG. 1) is introduced into the above-mentioned annular spaces 47. Therefore, the suction air pressure which would be exerted on the oil seals 27 is reduced to a satisfactory level. For the front bearings 37, the suction air pressure which would be exerted on the bearings 37 per se also is reduced.

On the other hand, in the engine idling condition, the computer 13 determines the engine idling condition by detecting that the engine speed is lower than a prescribed value, for example, by an engine speed sensor, and then sends a command to turn Off the solenoid valve 9. Thus, the valve element 10 of the control valve 9 blocks the communication between the passages 7 and 8 with the help of the spring 11. Consequently, although the suction air pressure is exerted on the bearing oil seals 27 and bearings 37, the engine speed is so low that the performance of the oil seals 27 or bearing grease is not affected. In this engine idling condition, since the control valve 9 is closed, the atmospheric air is not introduced into the annular spaces 47 and thus the amount of suction air in the pump chamber 52 and in the intake passage 16 of the engine is not increased through the labyrinth 46. Therefore, the engine speed also is not increased at the engine idling condition.

As mentioned hereinbefore, according to the present invention, under normal driving conditions of the engine, although the suction air pressure can act on the bearings, the pressure difference is considerably reduced by introduction of the atmospheric air. Therefore, the grease packed in the bearings for lubrication is retained in the bearings by the oil seal 27, even though the temperature of suction air is raised by the pumping action of the Roots-type pump, and therefore, the temperature of the grease is slightly raised by the higher temperature of the suction air.

In addition, when the Roots-type pumps 4, i.e. the solenoid clutch means 55 is turned Off, the control valve 9 can be opened to positively introduce air through the Roots-type pump 4 into the air intake passage 5. In this case, contrary to the above, reduction of engine speed due to the resistance of the Roots-type pump 4 can be prevented.

We claim:

1. A supercharger of an internal combustion engine having a Roots-type pump:

a pump housing for defining therein a pump chamber having an inner wall and an air inlet and air outlet;

a pair of rotor shafts mounted in parallel and each rotatably supported in said housing by means of a pair of bearings, said rotor shafts respectively rigidly carrying rotors in such a manner that small clearances are defined between said pair of rotors, and between said rotors and the inner wall of the housing chamber;

means for rotating said pair of rotors synchronously in opposite directions so as to suck air from the air inlet into the pump chamber and discharge the air from the pump chamber through the air outlet;

each of said rotors having, at respective axial ends thereof, end faces substantially perpendicular to the rotor shaft;

said housing defining annular spaces around said rotor shafts and between said axial end faces of the rotors and said bearings; and air passage means for connecting said annular spaces in the housing to the atmosphere, said passage means having a valve for controlling the air passage means in accordance with the engine driving conditions.

2. A supercharger as set forth in claim 1, wherein each of said bearings is a rolling bearing comprising an inner bearing race, rolling elements, and an outer bearing race, and said inner race bearing engages with a step portion of the rotor shaft, the inner diameter of the bearing being smaller than that of the annular space adjacent to the bearing.

3. A supercharger as set forth in claim 2, wherein the outer bearing race of each said bearing engages with a step bore portion of the housing, the outer diameter of the bearing being larger than that of the annular space adjacent to the bearing.

4. A supercharger as set forth in claim 1, wherein said valve is closed when the engine is in a low speed condition, such as an idling condition.

5. A supercharger as set forth in claim 1, wherein said valve is a solenoid valve.

* * * * *